US006386461B1

(12) United States Patent
Wildgoose

(10) Patent No.: US 6,386,461 B1
(45) Date of Patent: May 14, 2002

(54) RAIL PADS

(75) Inventor: Thomas William Wildgoose, Peterborough (GB)

(73) Assignee: Glynwed Pipe Systems Limited, Birmingham (GB)

( * ) Notice: Subject to any disclaimer, the term of this patent is extended or adjusted under 35 U.S.C. 154(b) by 0 days.

(21) Appl. No.: 09/381,147

(22) PCT Filed: Mar. 13, 1998

(86) PCT No.: PCT/GB98/00624

§ 371 Date: Nov. 27, 2000

§ 102(e) Date: Nov. 27, 2000

(87) PCT Pub. No.: WO98/41690

PCT Pub. Date: Sep. 24, 1998

(30) Foreign Application Priority Data

Mar. 14, 1997 (GB) ..... 9705396
Jan. 15, 1998 (GB) ..... 9800714

(51) Int. Cl.[7] ..... E01B 9/00
(52) U.S. Cl. ..... 238/283
(58) Field of Search ..... 238/283, 349, 238/351, 382

(56) References Cited

U.S. PATENT DOCUMENTS 4,723,706 A 2/1988 Ortwein ..... 238/283
5,549,245 A * 8/1996 Kish ..... 238/283

FOREIGN PATENT DOCUMENTS

| | | |
|---|---|---|
| EP | 0 191 308 | 1/1986 |
| EP | 0 620 317 A1 | 2/1994 |
| GB | 527362 | 4/1939 |
| GB | 1029247 | 8/1961 |
| GB | 2 152 119 A | 7/1985 |
| GB | 2 235 003 A | 2/1991 |

* cited by examiner

*Primary Examiner*—Mark T. Le
(74) *Attorney, Agent, or Firm*—Kinney & Lange, P.A.

(57) ABSTRACT

A rail pad that is formed from elastomeric material has an upper face adapted to underlie a lower face of a rail. The lower face is adapted to overlie a concrete rail foundation member. The elastomeric rail pad generally has a rectangular plan configuration. The elastomeric pad includes a reinforcement member, which is generally parallel to its mean plane and which extends at least between dispositions associated with generally opposing comers of the generally rectangular pad. The reinforcing member has a tensile strength sufficient to resist forces from traffic passing across the rail, which tend to stretch the pad in the mean plane.

24 Claims, 7 Drawing Sheets

RAIL PADS

This invention relates to rail pads. Such pads are interposed between the lower surface of a railway rail and a foundation member on which the rail stands and to which it is usually secured. The rail foundation member may, for example, be a concrete or steel sleeper extending across the railway track, or a slab or plate, for example, running along the length of the rail.

The purpose of the rail pad is to protect the foundation member from impulsive and other loads from passing rail traffic; to compensate for any unevenness in the foundation member; and, where the rail is electrical, to provide electrical insulation between the rail and the foundation member.

Such rail pads were from their working disposition, subject to considerable potentially damaging forces as railway traffic passes along the rail supported by the pads, and the recurrent common problem with such pads was the damage so caused, and the inevitable need for frequent replacement at substantial cost.

To alleviate this problem it has been established that the provision of an elastomeric rail pad of generally rectangular plan configuration having an upper surface adapted to underlie the lower face of a rail, and a lower face adapted to overly a concrete rail foundation member in which the pad is studded on the upper side (underlying the rail) will substantially improve the attenuation of the rail foundation member from forces exerted by the rail due to traffic passing thereacross.

Whilst such an arrangement has been singularly effective in reducing damaging forces upon the pad and the foundation member therebelow, particularly when the foundation member or sleeper contains recesses or pockets to contain ant position the pads under the rail. In this purpose-built assembly, pads are able to withstand high vertical and side loading whilst providing shock attenuation and minimising track damage with no possibility of extrusion caused by side loading.

The improved behaviour resulting from the use of rail pads in flat sleeper assemblies can be outweighed by the tendency of pads to be extruded and "lost" from under track by high side forces, this condition having particular effect when trains are negotiating bends in the track and when high axle loads are present.

It is especially to these conditions of track where sleepers do not have containment pockets from pads and also where high slide loads are present that the present invention is directed, and it is an object of the present invention to overcome or at least substantially reduce the problems identified above.

In accordance with the invention there is provided an elastomeric rail pad of generally rectangular plan configuration, the pad having an upper face adapted to underlie the lower face of a rail, and a lower face adapted to overly a concrete rail foundation member characterised in that the pad includes reinforcement means which is generally parallel to its mean plane, and extending at least between dispositions associated with generally opposing corners of the generally rectangular pad, said reinforcing means having a tensile strength such as to resist, in use of the pad, forces from traffic passing across the rail disposed thereabove otherwise tending to stretch the pad in the mean plane thereof.

The reinforcing means can be associated with the lower or upper faces of the pad, or elsewhere, but in one preferred embodiment may be associated with the lower face of the pad.

The reinforcing means may be of a sufficient tensile strength plastic, such as nylon, or a metal such as steel, and may be disposed within the pad by forming the pad about such reinforcement, or may comprise a member attached to, for example, the base of the pad.

The reinforcement means may comprise a member of any appropriate configuration to achieve the desired result hereinabove specified, and in one embodiment may be in the form of a cruciform extending between corners of the generally rectangular pad.

The pad can have smooth lower and/or upper surfaces, or the upper and optionally the lower surface can have an array of grooves, ridges, studs or other protrusions or recesses for the purpose of improving the cushioning properties of the pad.

The pad, in a preferred embodiment, may be of a single sided nature in that a plurality of protrusions to improve the attenuation of the rail foundation member may be disposed solely on the upper face of the pad. In this case, the reinforcement means typically is recessed into the lower face of the pad so as not to increase to overall height of the assembly. In other embodiments the reinforcing means may be disposed within the pad which then may be again of a single upper face protrusion laden pad, or may be both upper and lower protrusion laden.

The generally rectangular plan configuration of the rail pad may have rectangular recesses (in plan view) along two opposed sides midway along those sides, thereby defining on each end of such recesses what can be termed "ear" portions of the pad which in use locate the pad with respect to the anchoring assembly thereof between the overlying rail and the underlying rail foundation member. In this case the reinforcing means may be configured such as to extend into the wings, thereby providing stiffness thereto, with significant affecting practice and preventive movement of the pad from its required disposition between the rail and rail support member.

In a further aspect, the invention provides a method of protecting a foundation member for a railway rail from impulsive and other loads from rail traffic passing over this rail, which method comprises positioning between the foundation member and the railway rail an elastomeric rail pad as hereinbefore defined.

In a still further aspect, the invention provides a method of preventing extrusion of a rail pad from between a foundation member and a railway rail, which method comprises providing the rail pad with reinforcing means as hereinbefore defined.

In order that the invention may be more readily understood, one embodiment thereof will now be described by way of example with reference to the accompanying drawings in which.

Figure 1:
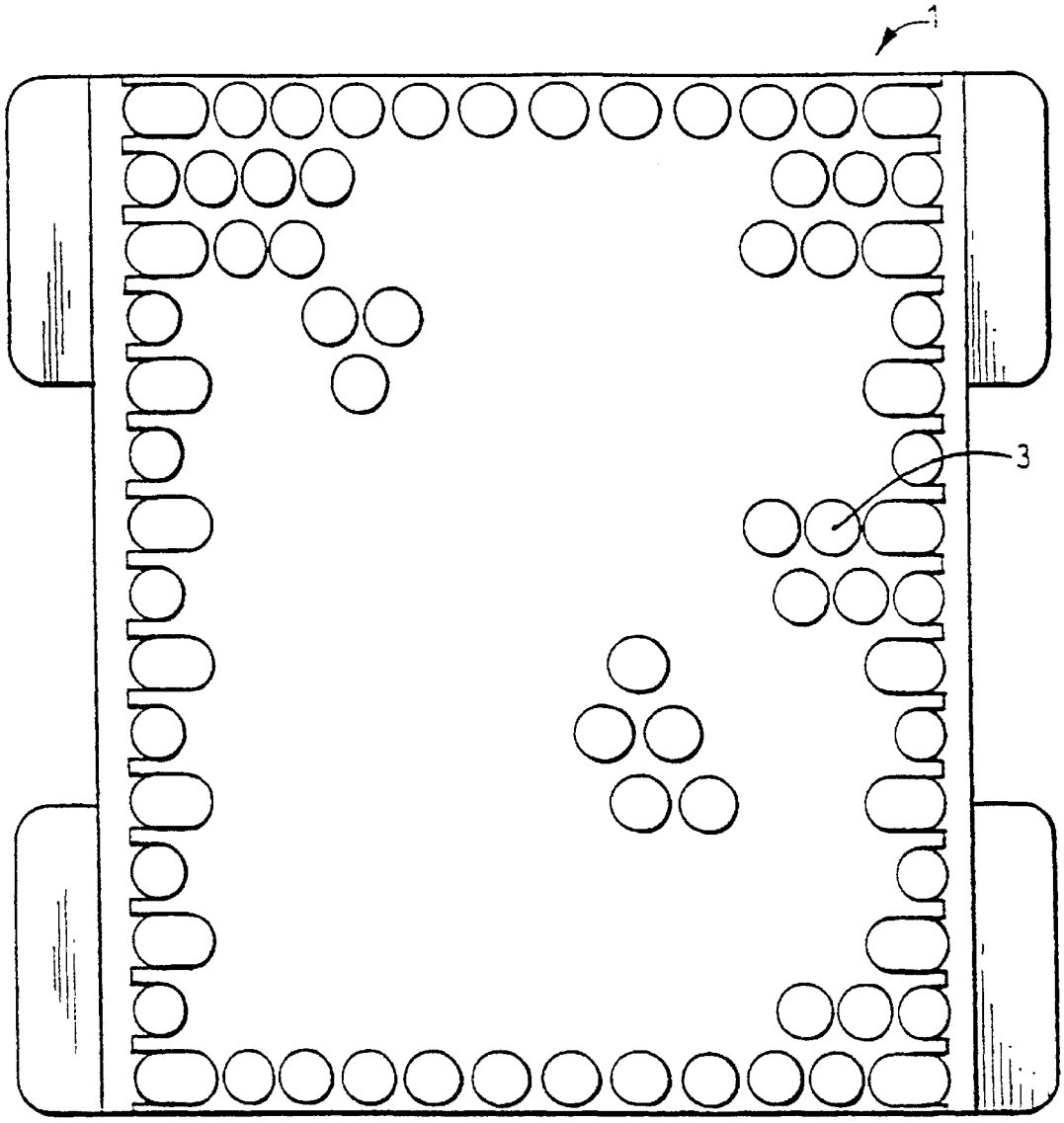
FIG. 1 is a top plan view of a rail pad to which the invention can be applied.
Figure 2:
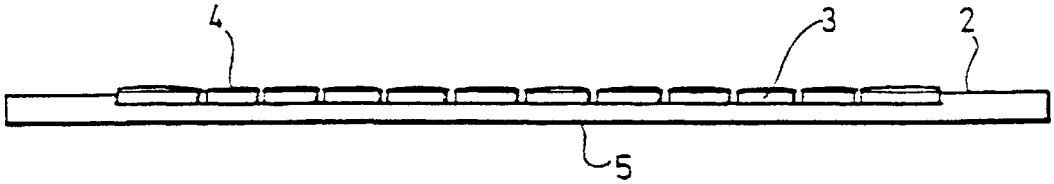
FIG. 2 is a schematic side view of the rail pad of FIG. 2.

Referring now to FIG. 1 and 2 a rail pad 1 is shown. This is formed of highly resilient vulcanised natural rubber (between 55% and 75% rebound value) or other appropriate elastomeric material having the same characteristics such as a plastics or synthetic rubber. Desirably the material from which the pad is formed will have an IRHD hardness of between 50 and 90.

The upper surface 2 of the pad is provided with a plurality of studs 3 each having a domed outer surface 4. Such arrangement of studs has been found to increase the attenuation provided by the pad between the overlying rail and the underlying foundation member during use as a result of the passage of rail traffic.

As can clearly be seen from FIG. 2 the under side 5 of the pad is of plane configuration.

Figure 3:
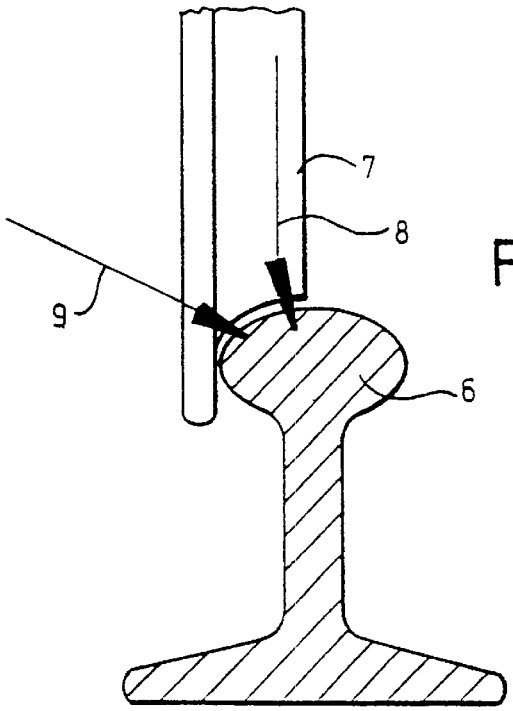
FIG. 3 shows tile forces applicable upon a rail which affect a pad disposed therebelow.

FIG. 3 illustrates the vertical (8) and transverse (9) forces, very schematically, acting upon a rail 6 when a wheel 7 of rail traffic passing thereabove acts upon the rail.

Figure 4:
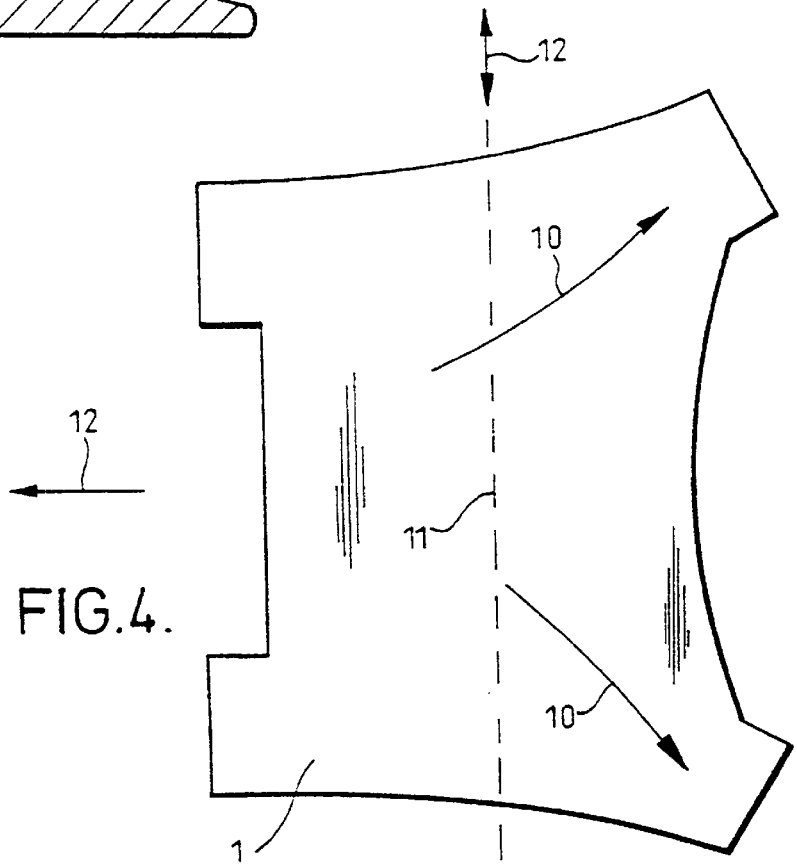
FIG. 4 shows the resultant stress and stretching of a pad disposed between a rail and a rail support member.

As can be seen in FIG. 4 this result in stresses 10 upon a rail pad 1 disposed between the rail 6 and a rail support member (not shown), the axis of the rail being along the line 11, and the upstream/downstream direction being as shown by arrow 12 parallel to axis 11. It will be seen that the effect of the forces by traffic on the rail stretch and attenuate the rail pad 1 such as to deform the same and reduce its effectiveness.

Figure 5:
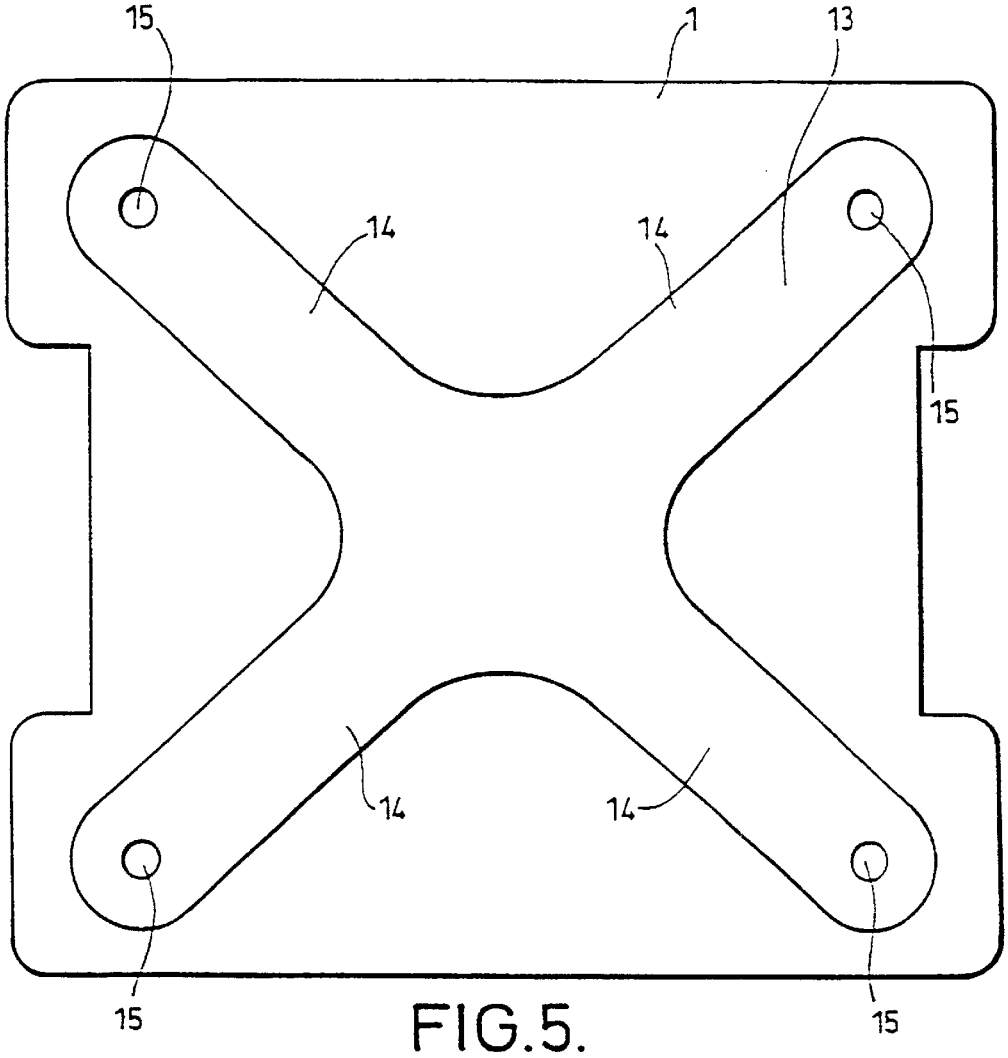
FIG. 5 shows an underview of a pad incorporating the invention.

FIG. 5 illustrates schematically from below the underside of the rail pad 1 of FIGS. 1 and 2 the attachment of a cross-shaped member 13 (formed for example from a metallic material or a plastics material such as polyamide) which in practice is arranged to ensure, because of its relatively high tensile strength compared to that of the pad, that the stretching of the pad is very strictly limited compared to the situation illustrated in FIG. 4. It will be seen that the cross-shaped support member 13 has apertures 15 at the ends of its arms 14, by means of which rivets or the like may attach the nylon reinforcement cross 13 to the base of the pad 1, which thereby holds the pad in place. As an alternative to rivets, the pad 1 can be moulded with lugs which protrude through the apertures 15 to hold the support member 13 in place.

Figure 6:
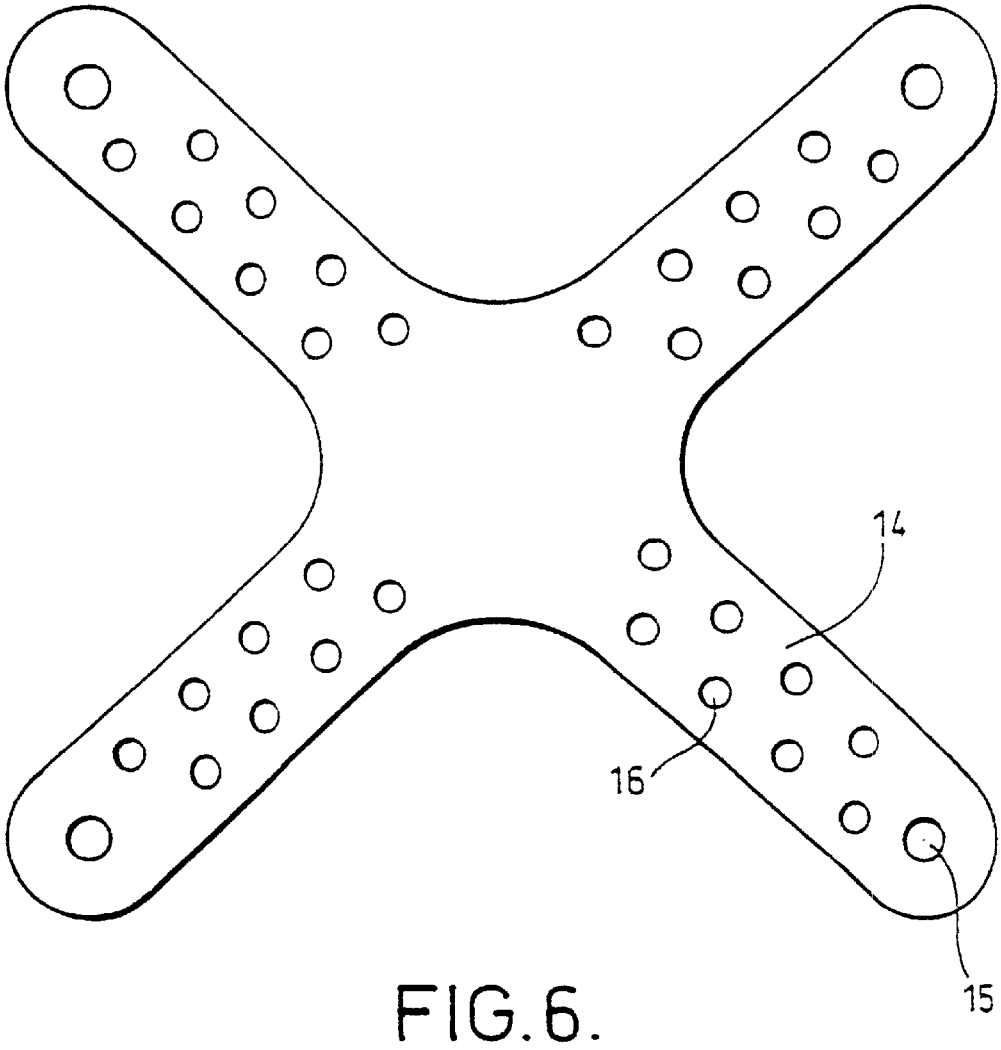
FIG. 6 shows in more detail the reinforcing member illustrated in FIG. 5.

FIG. 6 is a somewhat more detailed plan illustration (still schematic) of the reinforcement member 13 illustrated in FIG. 5. In addition to the end most apertures 15 at the ends of the limbs 14, a plurality of further apertures 16 (which can be of various shapes in addition to the shapes illustrated) are shown disposed along the arms of the reinforcement member 13. These apertures receive, without protrusion therebelow, securement rivets (not shown) to the rail pad to which they must be attached, By appropriate securement through several or all of the apertures in the limbs, a very secure engagement between the reinforcing member 13 and the pad 1 disposed thereabove can be obtained as is necessary in the circumstances. Again, as with the embodiment of FIG. 5, the pad can be provided with protrusions or lugs which fit into the apertures to hold the reinforcing member in place, in place of rivets. Alternatively, the pad 1 can be moulded against the reinforcing member 13 such that the material from which the pad is formed penetrates and keys into the apertures 15 during the moulding operation. In addition to (or instead of) the physical attachment provided by virtue of the rubber of the pad penetrating the apertures 15, securement of the reinforcing member can be achieved or assisted by the use of suitable adhesive bonding agents. A still further method of securing the reinforcing member 13 in place is to coat the member 13 with a chemical bonding agent which, when activated during vulcanization of the rail pad, will provide crosslinking at the interface between the member 13 and the pad 1.

By means of the invention, particularly as hereinabove illustrated, we have provided a reinforced rail pad where the resistance to displacement and/or distortion by forces from traffic passing thereover in use is most significantly increased, thereby increasing the useful life and the effectiveness of the rail pad concerned.

The reinforced rail pad of the present invention is able to provide a stable (non-extrudable) replacement for the multiplicity of existing pads which are in use in the United Kingdom and elsewhere. This enables a truly resilient pad with real and meaningful shock attenuation properties to be used. This enables a relatively inexpensive method of uprating track which is advantageous in all track without pocketed concrete sleepers.

Amongst other things it is especially beneficial for high axle load use and especially where tight bends are involved. This is often encountered outside the United Kingdom and on private lines such as ore carrying trains etc.

In addition, pads according to the invention could be used on light rail and tramways.

Figure 7:
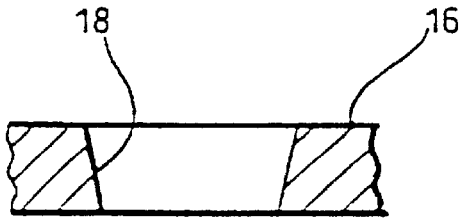
FIG. 7 shows in cross section a configuration of one of the bores within the reinforcing member of FIG. 6.

The rail pad illustrated in FIGS. 5 to 7 represents one preferred embodiment of the invention in that the arrangement of studs on the upper surface has been found to be particularly effective in cushioning the railway sleeper or other foundation member from the impulsive forces of rail traffic passing thereover. However, instead of having a plurality of stud-like protrusions on the upper surface thereof, the rail pad can have smooth upper and lower surfaces, or a grooved upper (and optionally lower) surface, and embodiments illustrating such arrangements are shown in FIGS. 8 to 13.

Figure 8:
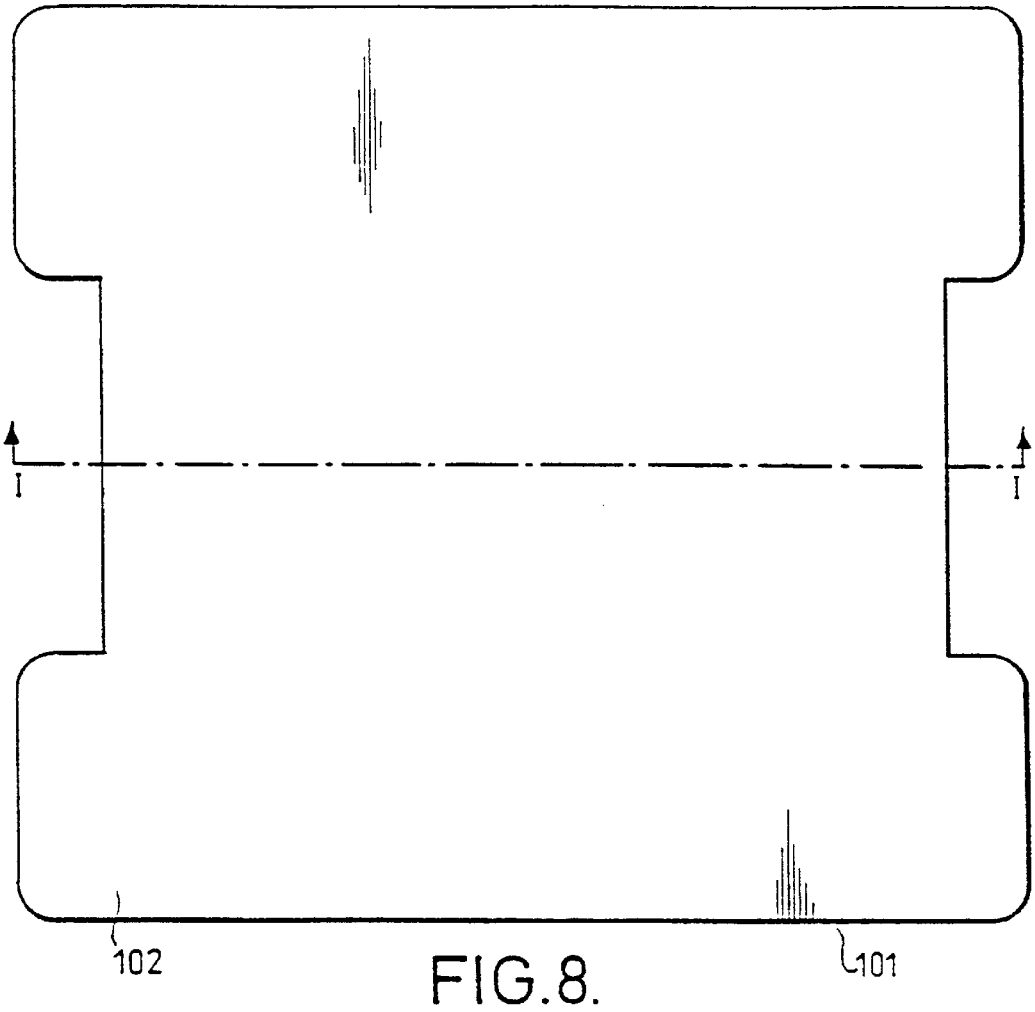
FIG. 8 is a plan view of a rail pad according to a second embodiment of the invtention.
Figure 9:
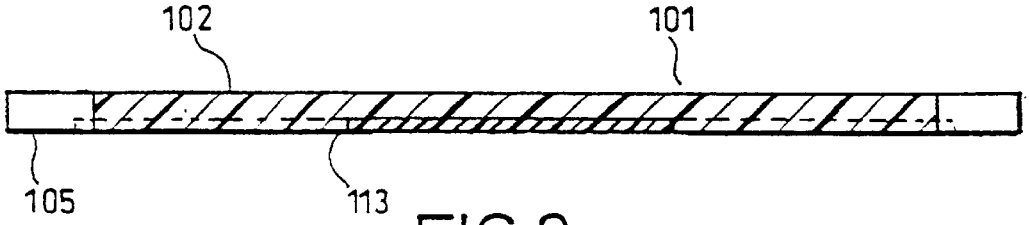
FIG. 9 is a sectional elevation along line I—I in FIG. 8.

In the rail pad of FIGS. 8 and 9, both the upper surface 102 and lower surface 105 of pad 101 are smooth, and a cruciform reinforcing member 113 is recessed into the lower surface 105 and held in place by means of lugs or protrusions (not shown) from the pad locating and locking into apertures (not shown) in the reinforcing member. Such apertures can be tapered in the manner shown in FIG. 7. Adhesives or crosslinking bonding agents can also be used to strengthen the securement of the pad to the reinforcing member if required.

Figure 10:
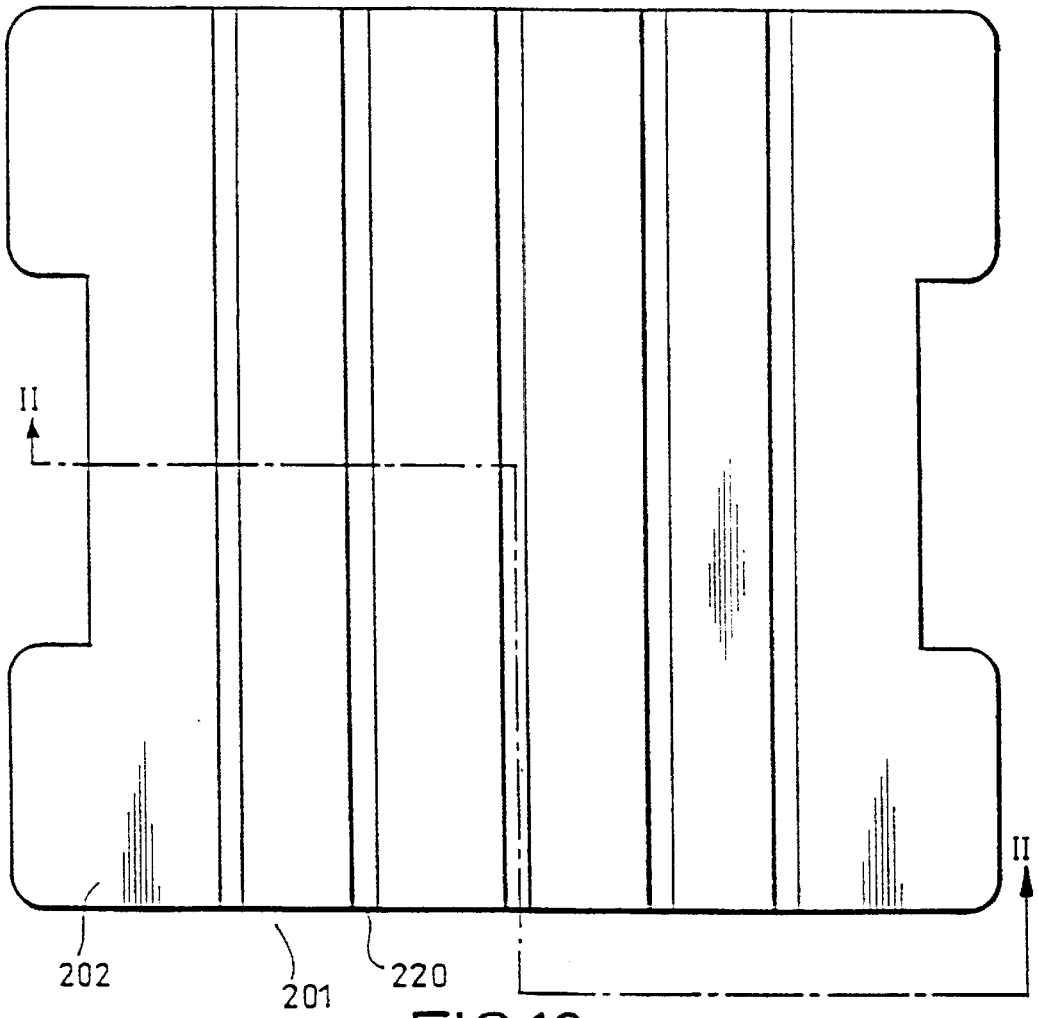
FIG. 10 is a plan view of a rail pad according to a third embodiment of the invention.
Figure 11:
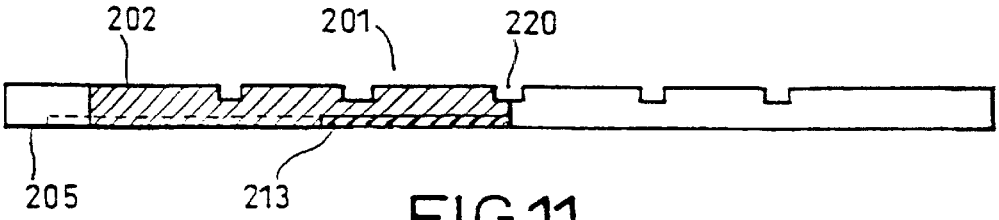
FIG. 11 is a sectional elevation along line II—II of FIG. 10.

In the rail pad of FIGS. 10 and 11, the lower surface 205 of pad 201 is smooth but across the upper surface 202 extends an array of parallel grooves 220. A cruciform reinforcing member 213 similar to that of the embodiments of FIGS. 5 to 9 is secured in a recess in the lower surface 205 by means of lugs or protrusions (not shown) from the pad as described above in relation to FIGS. 8 and 9. Although, in this embodiment, the lower surface 205 is shown as being smooth, it could if desired be provided with grooves similar to those found in the upper surface 202.

Figure 12:
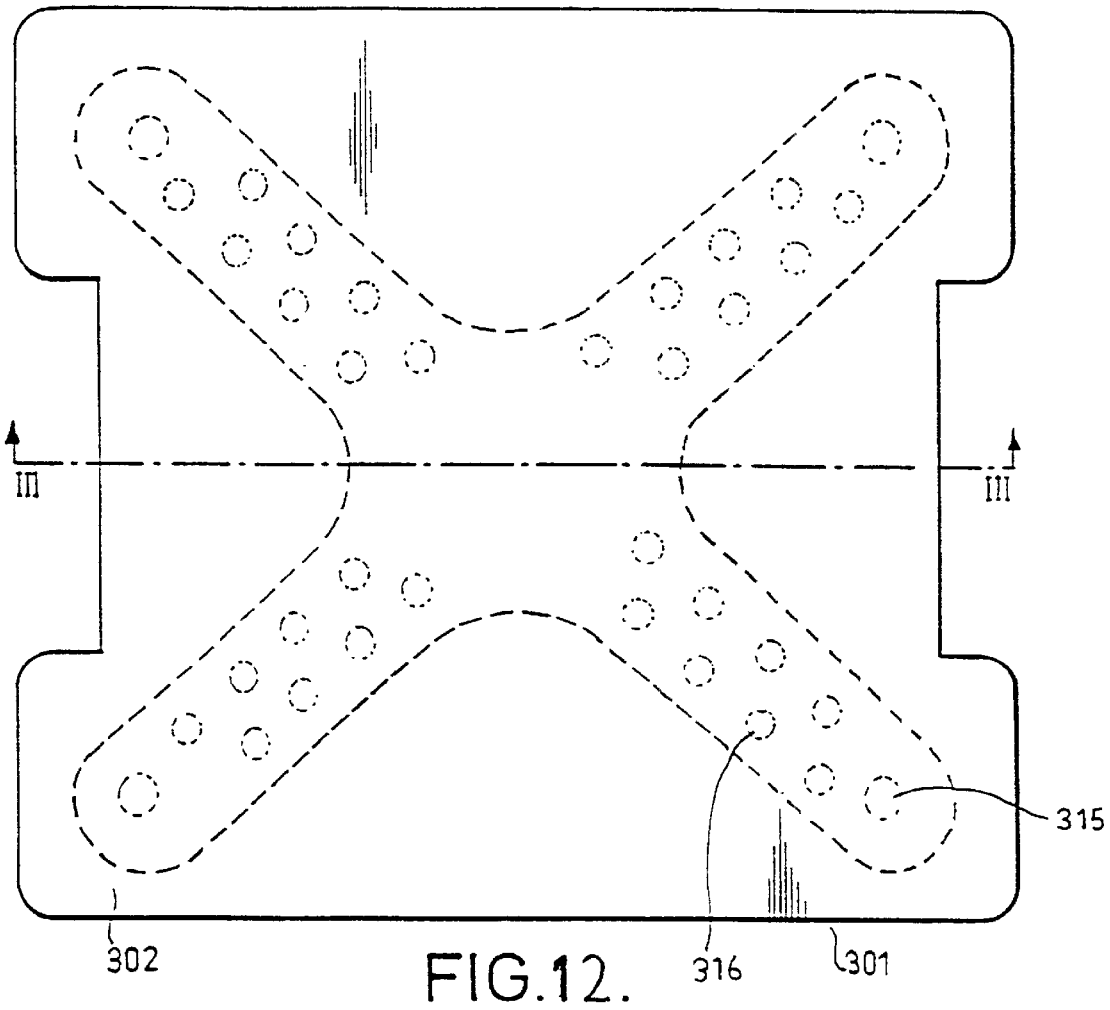
FIG. 12 is a plan view of a rail pad incorporating the reinforcing member of FIG. 6.
Figure 13:
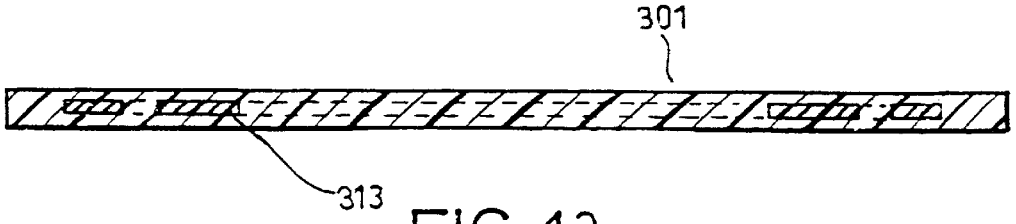
FIG. 13 is a sectional elevation along line III—III in FIG. 12.

FIGS. 12 and 13 show an embodiment in which the reinforcing member 313 is moulded into the pad 301 such that it is entirely surrounded by the pad material. In this embodiment, the rubber is moulded through the apertures 315 and 316 in the reinforcing member 313.

It is to be understood that the foregoing is merely exemplary of rail pads in accordance with the invention and that modifications can readily be made thereto without departing from the true scope of the invention.

What is claimed is:

1. An elastomeric rail pad of substantially rectangular plan configuration, the pad having:

an upper face adapted to underlie the lower face of a rail;

a lower face adapted to overlie a concrete rail foundation member;

a reinforcement means, other than fabric reinforcement, the reinforcement means being substantially parallel to a mean plane of the pad, the reinforcement means extending at least between substantially diagonally opposing corners of the pad;

said reinforcement means having a tensile strength such as to resist, in use of the pad, forces from traffic passing across the rail disposed thereabove otherwise tending to stretch the pad in the mean plane thereof;

wherein the reinforcement means is in the form of a cruciform extending between corners of the substantially rectangular pad.

2. An elastomeric rail pad according to claim 1 wherein the reinforcement means is contiguous with the lower face of the pad.

3. An elastomeric rail pad according to claim 1 wherein the reinforcement means comprises a member attached to the lower face of the pad.

4. An elastomeric rail pad according to claim 3 wherein the reinforcing member has a plurality of apertures disposed over its area, which apertures in use serve to grip elastomeric material of the rail pad.

5. An elastomeric rail pad of substantially rectangular plan configuration, the pad comprising:

an upper face adapted to underlie the lower face of a rail;

a lower face adapted to overlie a concrete rail foundation member;

a reinforcement means, other than fabric reinforcement, the reinforcement means being substantially parallel to a mean plane of the pad, the reinforcement means extending at least between substantially diagonally opposing comers of the pad;

said reinforcement means having a tensile strength such as to resist, in use of the pad, forces from traffic passing across the rail disposed thereabove otherwise tending to stretch the pad in the mean plane thereof;

wherein the reinforcement means is contiguous with the lower face of the pad;

wherein the reinforcement means comprises a reinforcing member attached to the lower face of the pad; and wherein the reinforcing member has a plurality of apertures disposed over its area, which apertures in use serve to grip elastomeric material of the rail pad.

6. An elastomeric rail pad according to claim 5 wherein the reinforcement means is contiguous with the upper face of the pad.

7. An elastomeric rail pad according to claim 5 wherein the reinforcement means is received within a recess in the lower face of the pad.

8. An elastomeric rail pad according to claim 5 wherein the reinforcement means is disposed within the pad by forming the pad thereabout.

9. An elastomeric rail pad according to claim 5 wherein the reinforcement means is formed from a plastics material.

10. An elastomeric rail pad according to claim 9 wherein the plastics material is a polyamide.

11. An elastomeric rail pad according to claim 5 wherein the reinforcement means is formed from a metal.

12. An elastomeric rail pad according to claim 5 having on the upper surface thereof, but not on the lower surface thereof, a plurality of protrusions to improve the attenuation of the rail foundation member.

13. An elastomeric rail pad according to claim 12 wherein the pad has a lower flat surface and the reinforcement means is attached to or recessed in the said lower, flat, surface.

14. An elastomeric rail pad according to claim 5 wherein the reinforcement means is disposed within the pad, and the upper surface but not the lower surface has protrusions thereon.

15. An elastomeric rail pad according to claim 5 wherein the reinforcement means is disposed within the pad, and at least one of the upper and lower surfaces has protrusions thereon.

16. An elastomeric rail pad according to claim 5 wherein the substantially rectangular plan configuration of the rail pad has rectangular recesses along two opposed sides midway along those sides, thereby defining ear portions of the pad on each end of such recesses, which ear portions in use locate the pad with respect to an anchoring assembly thereof between the overlying rail and the underlying rail foundation member.

17. An elastomeric rail pad according to claim 16 wherein the reinforcement means is configured such as to extend into the ear portions.

18. An elastomeric rail pad according to claim 5 wherein the pad is formed of an elastomeric material having a harness within a range of 50 to 90 IRHD.

19. An elastomeric rail pad of substantially rectangular plan configuration, the pad comprising:

an upper face adapted to underlie a lower face of a rail;

a lower face adapted to overly a concrete rail foundation member;

a reinforcement means in the form of a cruciform extending between corners of the pad;

the reinforcement means being substantially parallel to a mean plane of the generally rectangular pad and extending at least between substantially opposing corners of the pad, said reinforcement means having a tensile strength such as to resist, in use of the pad, forces from traffic passing across the rail disposed thereabove otherwise tending to stretch the pad in the mean plane thereof.

20. A method of protecting a foundation member for a railway rail from impulsive and other loads from rail traffic passing over the rail, which method comprises: forming an elastomeric rail pad to have a substantially rectangular plan configuration;

providing to the elastomeric rail pad with:

an upper face adapted to underlie the lower face of a rail;

a lower face adapted to overlie a concrete rail foundation member;

a reinforcement means, other than fabric reinforcement, the reinforcement means being substantially parallel to a mean plane of the pad, the reinforcement means extending at least between dispositions associated with substantially diagonally opposing corners of the pad, said reinforcement means having a tensile strength such as to resist, in use of the pad, forces from traffic passing across the rail disposed thereabove otherwise tending to stretch the pad in the mean plane thereof;

wherein the reinforcement means is in the form of a cruciform extending between corners of the substantially rectangular pad; and positioning the elastomeric rail pad between the foundation member and the railway rail.

21. An elastomeric rail pad according to claim 1 wherein the reinforcement means is contiguous with the upper face of the pad.

22. An elastomeric rail pad according to claim 1 wherein the reinforcement means is received within a recess in the lower face of the pad.

23. An elastomeric rail pad according to claim 1 wherein the reinforcement means is formed from a plastics material.

24. An elastomeric rail pad according to claim 1 wherein the reinforcement means is formed from a metal.

* * * * *

UNITED STATES PATENT AND TRADEMARK OFFICE

CERTIFICATE OF CORRECTION

PATENT NO. : 6,386,461 B1
DATED : May 14, 2002
INVENTOR(S) : Thomas William Wildgoose It is certified that error appears in the above-identified patent and that said Letters Patent is hereby corrected as shown below:

Column 2,
Line 5, delete “tile”, insert -- the --

Column 6,
Line 42, delete “harness”, insert -- hardness --

Signed and Sealed this

Fourteenth Day of January, 2003

JAMES E. ROGAN
*Director of the United States Patent and Trademark Office*